US009989891B2

(12) United States Patent
Kato et al.

(10) Patent No.: US 9,989,891 B2
(45) Date of Patent: Jun. 5, 2018

(54) DEVELOPING DEVICE AND IMAGE FORMING APPARATUS

(71) Applicant: FUJI XEROX CO., LTD., Tokyo (JP)

(72) Inventors: Nao Kato, Kanagawa (JP); Takashi Nakamura, Kanagawa (JP); Kenji Hayamizu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/218,231

(22) Filed: Jul. 25, 2016

(65) Prior Publication Data

US 2017/0227890 A1 Aug. 10, 2017

(30) Foreign Application Priority Data

Feb. 10, 2016 (JP) ..... 2016-024080

(51) Int. Cl.
*G03G 15/08* (2006.01)

(52) U.S. Cl.
CPC ..... *G03G 15/0893* (2013.01); *G03G 15/0865* (2013.01)

(58) Field of Classification Search
CPC ..... G03G 15/0834; G03G 15/0839; G03G 15/0891; G03G 15/0865
See application file for complete search history.

(56) References Cited

U.S. PATENT DOCUMENTS 5,510,882 A * 4/1996 Kikuta ..... G03G 15/0822 399/257

FOREIGN PATENT DOCUMENTS

JP 2002-278168 A 9/2002
JP 2011-2526 A 1/2011

* cited by examiner

*Primary Examiner* — Erika J Villaluna
(74) *Attorney, Agent, or Firm* — Sughrue Mion, PLLC

(57) ABSTRACT

A developing device includes a storage unit that stores developer to be used to form a developer image on an image carrier, the developer containing toner and carrier, an auxiliary storage unit that stores the developer and is connected to the storage unit via a first opening from which the developer is supplied into the storage unit and a second opening from which the developer in the storage unit is taken in, a first transport member provided at the first opening to transport the developer in the auxiliary storage unit into the storage unit, a second transport member provided at the second opening to transport the developer in the storage unit into the auxiliary storage unit, and a supply unit that has an opening opposed to the first transport member and supplies toner to the developer transported from the auxiliary storage unit into the storage unit.

20 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2016-024080 filed Feb. 10, 2016.

BACKGROUND (i) Technical Field

The present invention relates to a developing device and an image forming apparatus.

(ii) Related Art

In a developing device in which developer containing toner serving as an image forming material and carriers serving as a transport medium for the toner is supplied to a bearing member for development while being agitated and transported by an agitating member, toner is supplied according to the toner concentration. In a structure using a toner concentration sensor to detect the toner concentration, when the amount of toner consumed by development increases and the transport amount (transport speed) of developer transported per unit time by the agitating member exceeds a reference speed, the amount of developer around the toner concentration sensor sometimes increases. In this case, the difference between the supply amount and the required amount of toner increases, and this may hinder supply of required toner.

SUMMARY

According to an aspect of the invention, there is provided a developing device including a storage unit that stores developer to be used to form a developer image on an image carrier, the developer containing toner and carrier, an auxiliary storage unit that stores the developer and is connected to the storage unit via a first opening from which the developer is supplied into the storage unit and a second opening from which the developer in the storage unit is taken in, a first transport member provided at the first opening to transport the developer in the auxiliary storage unit into the storage unit, a second transport member provided at the second opening to transport the developer in the storage unit into the auxiliary storage unit, and a supply unit that has an opening opposed to the first transport member and supplies toner to the developer transported from the auxiliary storage unit into the storage unit.

BRIEF DESCRIPTION OF THE DRAWINGS

An exemplary embodiment of the present invention will be described in detail based on the following figures, wherein:

FIG. 5A is a VA-VA cross-sectional view, FIG. 5B is a VB-VB cross-sectional view, and FIG. 5C is a VC-VC cross-sectional view;

DETAILED DESCRIPTION

Configuration of Image Forming Apparatus

Figure 1:
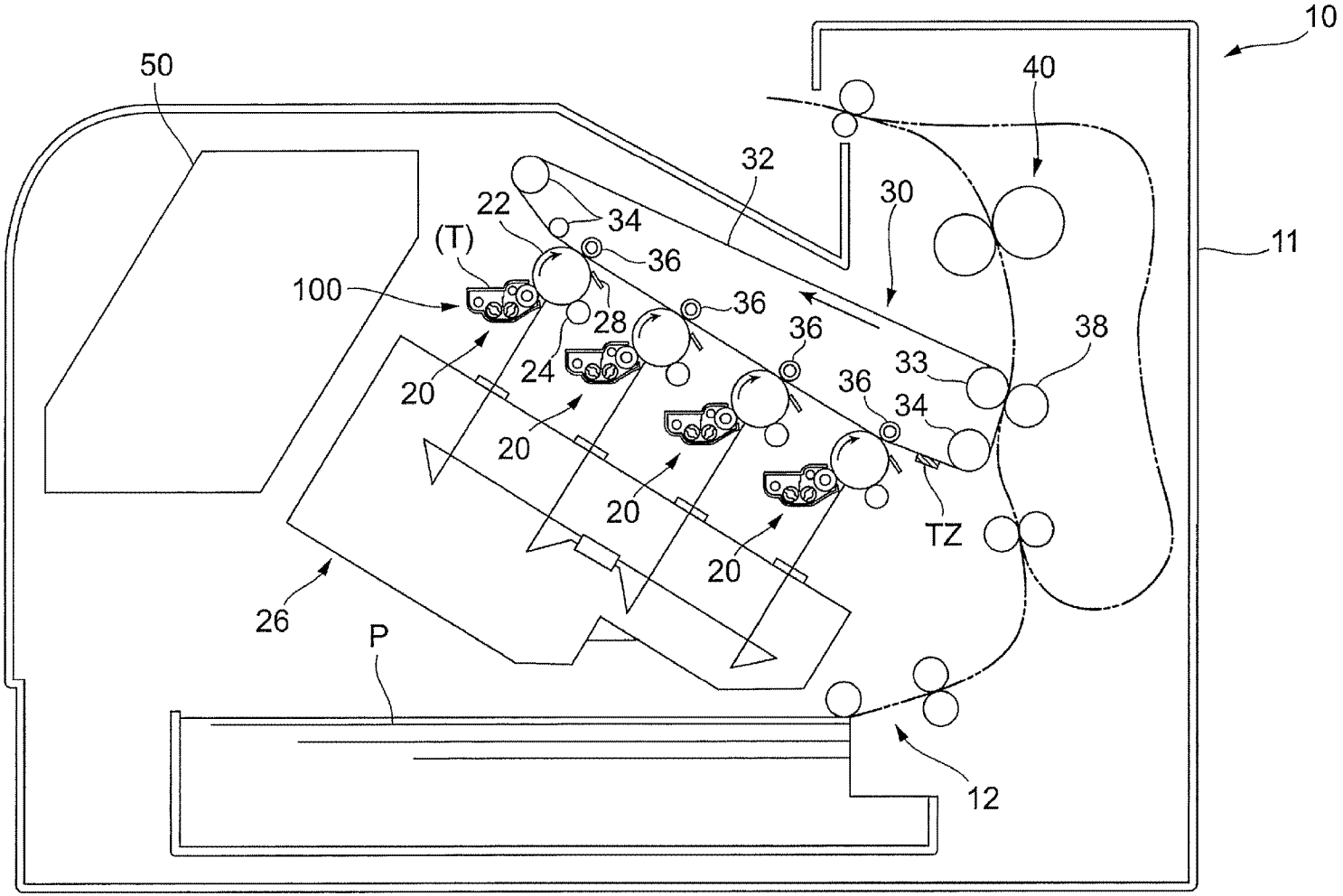
FIG. 1 illustrates an overall configuration of an image forming apparatus to which an exemplary embodiment is applied.

FIG. 1 illustrates an exemplary configuration of an image forming apparatus to which an exemplary embodiment is applied.

An image forming apparatus 10 illustrated in FIG. 1 includes a transport unit 12 that transports paper P, four image forming units 20 that each form a toner image TZ, a transfer unit 30 that transfers the toner image TZ onto the paper P, and a fixing unit 40 that fixes the toner image TZ on the paper P. The four image forming units 20 have a similar structure, and are different in the color of used toner (for example, four colors of yellow, cyan, magenta, and black). The image forming apparatus 10 also includes a controller 50 that controls operations of the components and units. Herein, the paper P is an example of a recording medium, and the toner image TZ is an example of a developer image.

Each of the image forming units 20 includes a photoconductor 22 serving as an example of an image carrier, a charging roller 24 that charges the photoconductor 22, an exposure unit 26 that forms a latent image by exposing the charged photoconductor 22, and a developing device 100 that forms a toner image TZ on the photoconductor 22. Each image forming unit 20 also includes a cleaning blade 28 that cleans the photoconductor 22. In this way, the image forming unit 20 is an electrophotographic unit that performs processes of charging, exposure, development, and cleaning.

Figure 3:
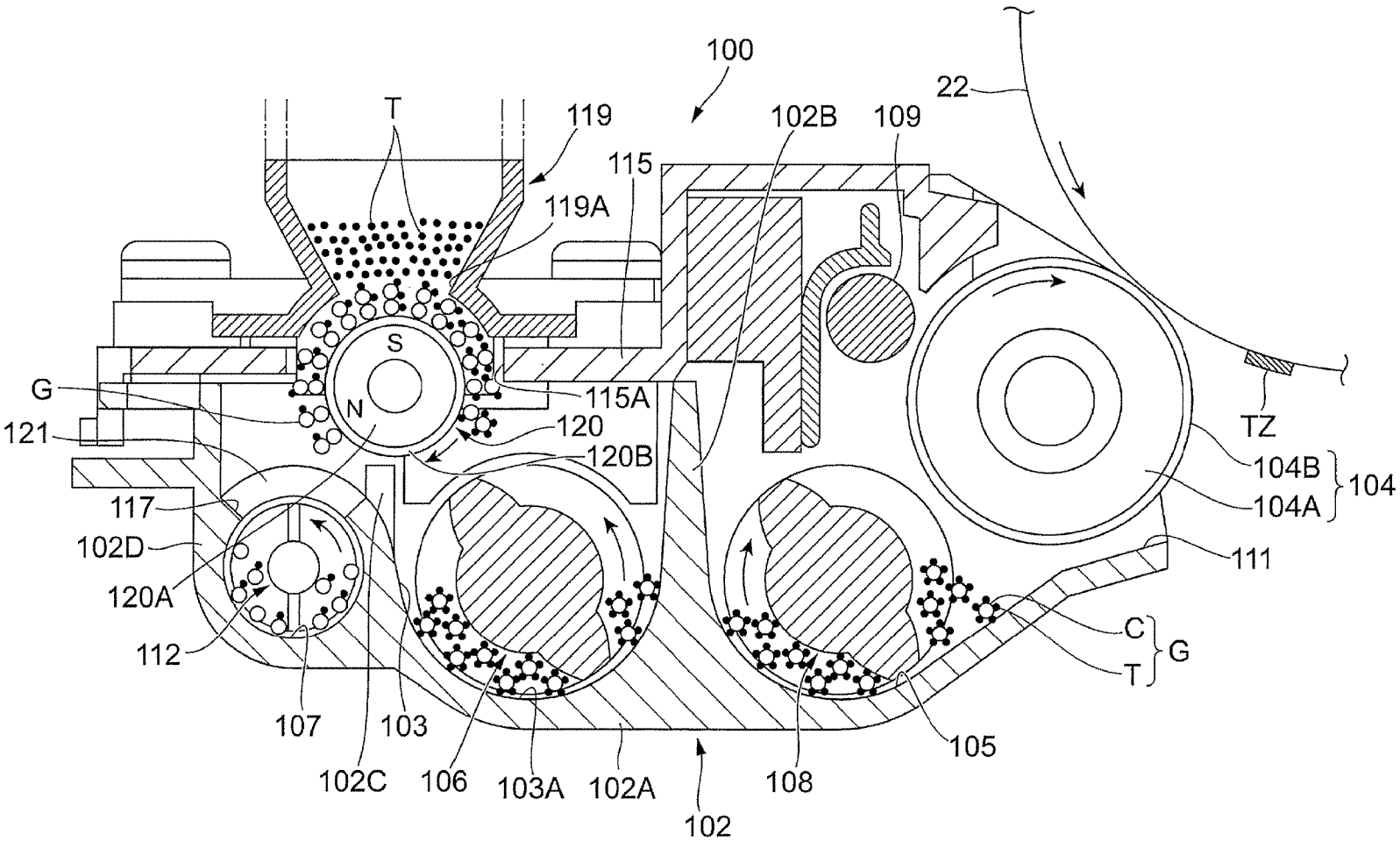
FIG. 3 is a cross-sectional view taken along line III-III of FIG. 2.

The developing device 100 forms a toner image TZ by performing development using developer G (see FIG. 3). As illustrated in FIG. 3, for example, the developer G is mainly composed of nonmagnetic toner T to be negatively charged and magnetic carrier C to be positively charged, and further contains an additive.

The transfer unit 30 includes a transfer belt 32 on which a toner image TZ is transferred from each photoconductor 22, a driving roller 33 and driven rollers 34 on which the transfer belt 32 is wound, four first transfer rollers 36, and a second transfer roller 38. Each of the first transfer rollers 36 first-transfers a toner image TZ on the corresponding photoconductor 22 onto the transfer belt 32 by a potential difference from the grounded photoconductor 22. The second transfer roller 38 second-transfers the toner image TZ on the transfer belt 32 onto transported paper P by a potential difference from the grounded driving roller 33.

Developing Device

Figure 2:
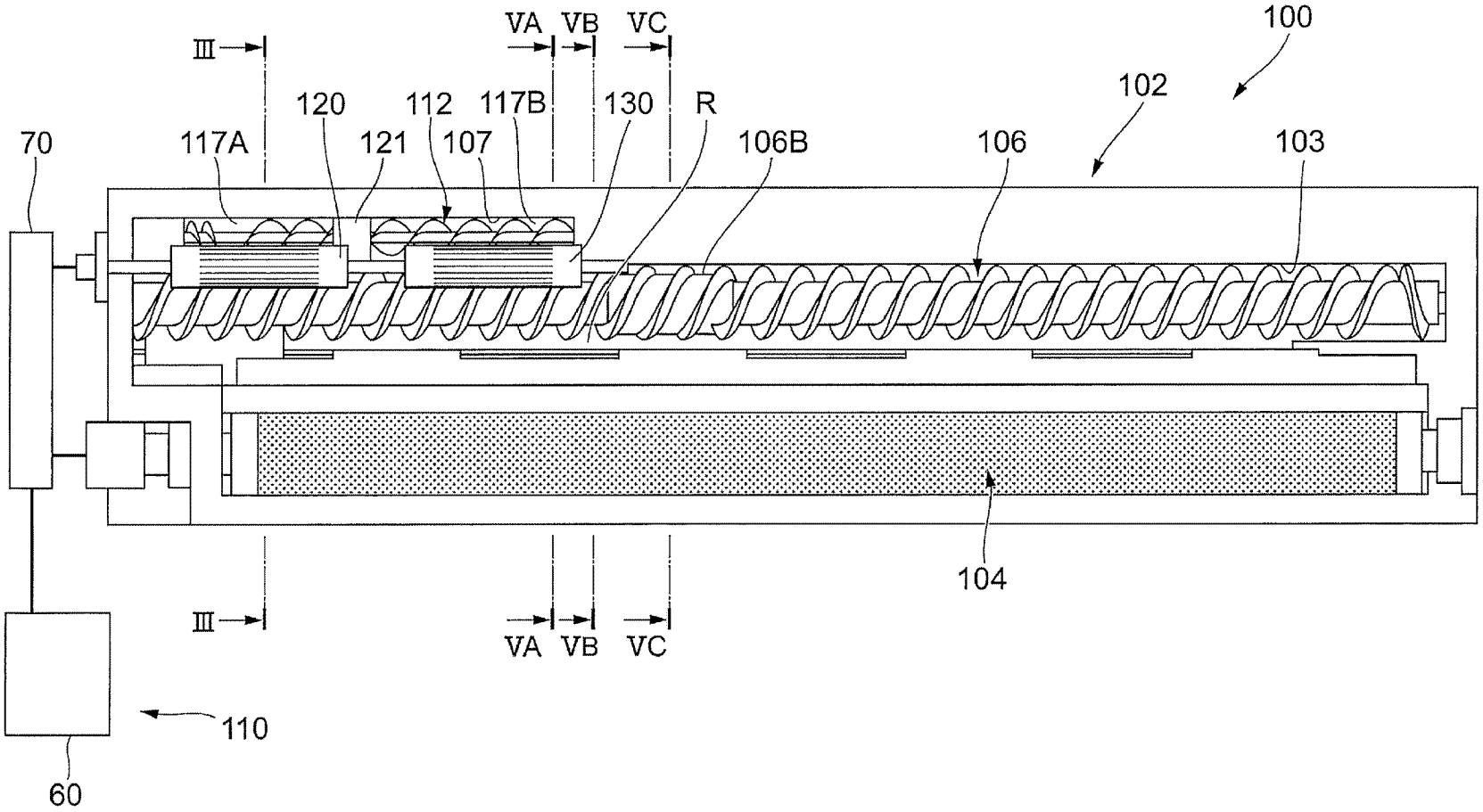
FIG. 2 illustrates a structure of a developing device.

FIG. 2 illustrates a structure of the developing device 100, and FIG. 3 is a cross-sectional view taken along line III-III of FIG. 2.

As illustrated in FIGS. 2 and 3, the developing device 100 includes a housing 102 serving as an example of a storage unit, a developing roller 104 serving as an example of a holding member, and a first agitating member 106 and a second agitating member 108 serving as an example of an agitating member. As illustrated in FIG. 2, the developing device 100 further includes a speed switch section 110 serving as an example of a change unit, a thick shaft portion 106B serving as an example of a retention unit, an auxiliary storage chamber 107 serving as an example of an auxiliary storage unit, a transport member 112, a first rotating member 120 (rotating body) serving as an example of a first transport member, and a second rotating member 130 (rotating body) serving as an example of a second transport member.

As illustrated in FIG. 3, the developing device 100 further includes a layer regulation member 109 that regulates the thickness of a layer of developer G retained on an outer peripheral surface of the developing roller 104, and a hopper unit 119 that stores toner T to be supplied into the housing 102 via the first rotating member 120. The hopper unit 119 serves as an example of a supply unit that supplies toner T to be supplied to the developer G in the storage unit. The housing 102 is provided with a covering member 115 that covers the housing 102. In FIG. 3, cross sections of some members are not hatched for easy view of the members.

As illustrated in FIG. 3, the housing 102 includes a bottom wall 102A, a first partitioning wall 102B standing in a center portion of the bottom wall 102A and serving as an example of a wall portion, and a second partitioning wall 102C standing on the bottom wall 102A beside the first partitioning wall 102B with a fixed space therebetween. The housing 102 further includes a side wall 102D standing in an edge portion around the bottom wall 102A. The housing 102 is open on one side (lower side in FIG. 2, right side in FIG. 3), and stores developer G therein.

Housing

Figure 4:
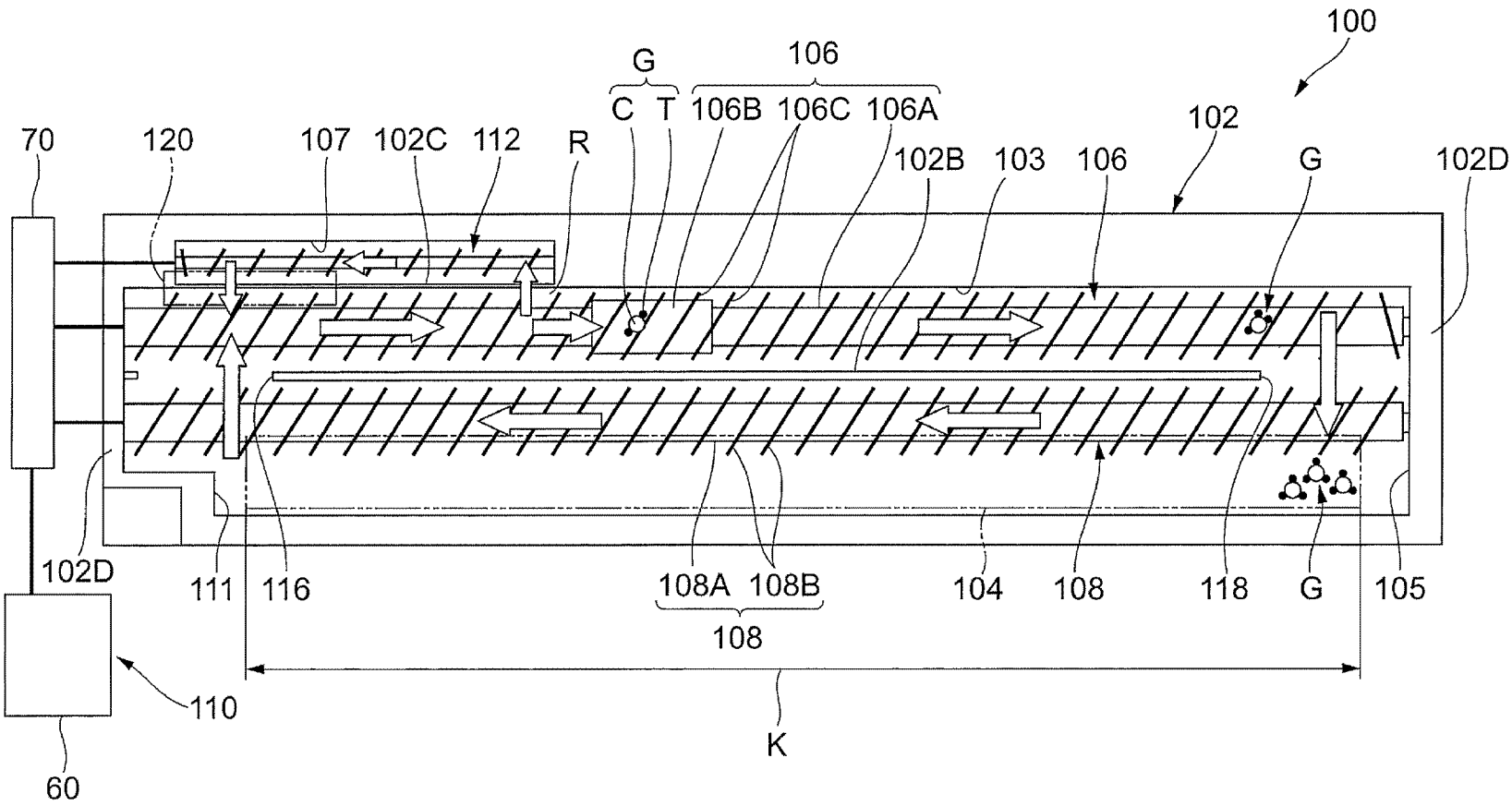
FIG. 4 illustrates a structure of a housing of the developing device.

FIG. 4 illustrates a structure of the housing 102 in the developing device 100.

As illustrated in FIG. 4, the housing 102 has a rectangular shape. The first partitioning wall 102B extends in a long-side direction of the housing 102 at a center portion in a short-side direction. In the illustrated example, the length of the second partitioning wall 102C is about ⅓ of the length of the first partitioning wall 102B, and the second partitioning wall 102C extends in the long-side direction of the housing 102. The interior of the housing 102 is partitioned by the first partitioning wall 102B and the second partitioning wall 102C to form a first agitation chamber 103, a second agitation chamber 105, and an auxiliary storage chamber 107. In the structural example of FIG. 4, the first agitation chamber 103 and the second agitation chamber 105 extend almost all over the housing 102 in the long-side direction. The auxiliary storage chamber 107 extends to an appropriate length in the long-side direction at a position close to one short side of the housing 102. In the illustrated example, the length of the auxiliary storage chamber 107 is about ⅓ of the length of the first agitation chamber 103. Therefore, the first agitation chamber 103 includes a portion that is adjacent to the auxiliary storage chamber 107 and a portion that is not adjacent to the auxiliary storage chamber 107.

The first agitation chamber 103 is located between the first partitioning wall 102B and the second partitioning wall 102C. The first agitation chamber 103 extends from a part of the side wall 102D on one short side of the housing 102 to a part of the side wall 102D on the other short side. In the first agitation chamber 103, a first agitating member 106 shaped like a rod is provided rotatably with an axial direction along the long-side direction of the housing 102. The first agitating member 106 includes a shaft portion 106A, a thick shaft portion 106B, and a first blade portion 106C. Details of the first agitating member 106 will be described later. As illustrated in FIG. 3, a bottom surface 103A of the first agitation chamber 103 is a semicircular curved surface, when viewed along the long-side direction of the housing 102 (direction perpendicular to the plane of FIG. 3).

Figure 5A:
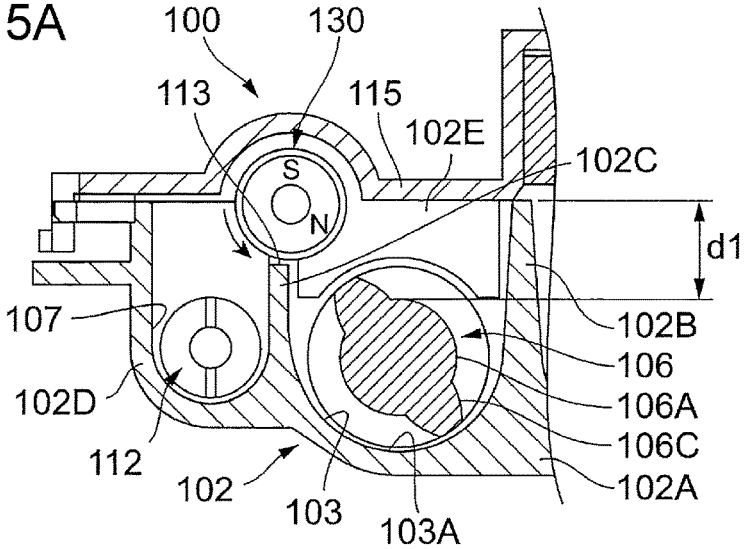
FIGS. 5A to 5C are cross-sectional views of the developing device of FIG. 2.
Figure 5B:
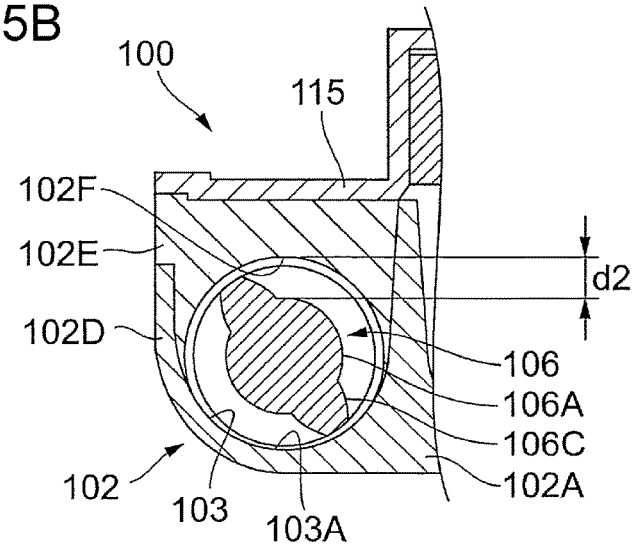
Figure 5C:
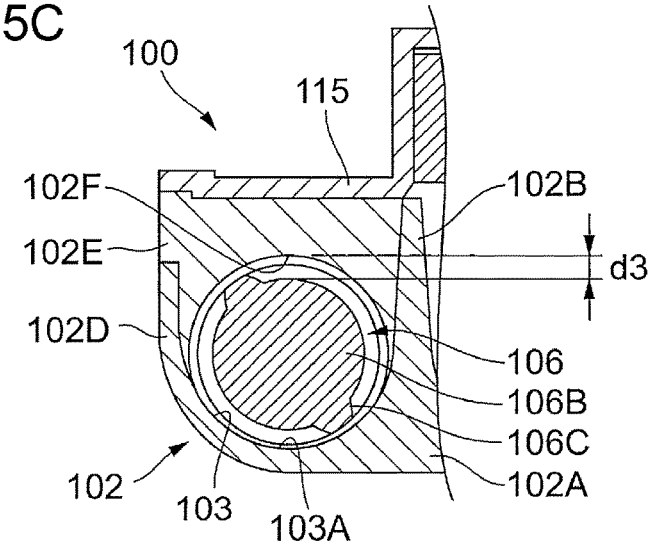

FIGS. 5A to 5C are cross-sectional views of the developing device 100 of FIG. 2. FIG. 5A illustrates a VA-VA cross section, FIG. 5B illustrates a VB-VB cross section, and FIG. 5C illustrates a VC-VC cross section. The VA-VA cross section corresponds to a position where the first agitation chamber 103 and the auxiliary storage chamber 107 are adjacent to each other. The VB-VB cross section corresponds to a position where the first agitation chamber 103 and the auxiliary storage chamber 107 are not adjacent to each other and the thick shaft portion 106B of the shaft portion 106A in the first agitating member 106 is not located. The VC-VC cross section corresponds to a position where the first agitation chamber 103 and the auxiliary storage chamber 107 are not adjacent to each other and the thick shaft portion 106B of the shaft portion 106A of the first agitating member 106 is located. In FIGS. 5A to 5C, the second agitation chamber 105, the second agitating member 108, a developing chamber 111, and the developing roller 104 are not illustrated.

As illustrated in FIG. 5A, the first agitation chamber 103 is surrounded by the bottom wall 102A, the first partitioning wall 102B, the second partitioning wall 102C, and the covering member 115 at the position adjacent to the auxiliary storage chamber 107. A distance d1 between the shaft portion 106A of the first agitating member 106 and the covering member 115 is more than the distance between the shaft portion 106A and the bottom wall 102A, the distance between the shaft portion 106A and the first partitioning wall 102B, and the distance between the shaft portion 106A and the second partitioning wall 102C.

As illustrated in FIGS. 5B and 5C, the first agitation chamber 103 is surrounded by the bottom wall 102A, the first partitioning wall 102B, the side wall 102D, and a flow passage member 102E to have a circular cross section at the position that is not adjacent to the auxiliary storage chamber 107.

The flow passage member 102E is a long member having a longitudinal direction along the long-side direction of the housing 102, and is attached to the housing 102 while being in contact with the first partitioning wall 102B, the side wall 102D, and the covering member 115. A surface of the flow passage member 102E opposed to the first agitating member 106 in a state in which the flow passage member 102E is attached to the housing 102 has a curved face 102F. The curved face 102F of the flow passage member 102E and the bottom surface 103A form a flow passage of circular cross section. Therefore, at the position of the VB-VB cross section of FIG. 5B, a distance d2 between the curved face 102F of the flow passage member 102E and the shaft portion 106A of the first agitating member 106 is substantially equal to the distance between the shaft portion 106A and the bottom wall 102A, the distance between the shaft portion 106A and the first partitioning wall 102B, and the distance between the shaft portion 106A and the second partitioning wall 102C. The distance d2 is shorter than the distance d1 in FIG. 5A.

At the position of the VC-VC cross section of FIG. 5C, the thick shaft portion 106B of the first agitating member 106 is located. The structures of the curved face 102F of the flow passage member 102E and the bottom surface 103A in the first agitation chamber 103 are similar to those at the position of the VB-VB cross section of FIG. 5B. At this position, a distance d3 between the curved face 102F of the flow passage member 102E and the thick shaft portion 106B is substantially equal to the distance between the thick shaft portion 106B and the bottom wall 102A, the distance between the shaft portion 106A and the first partitioning wall 102B, and the distance between the shaft portion 106A and the second partitioning wall 102C. This distance d3 is shorter than the distance d2 in FIG. 5B. For this reason, the cross-sectional area of the flow passage for the developer G inside the first agitation chamber 103 is smaller at the position of the thick shaft portion 106B than at the position of the shaft portion 106A in the VB-VB cross section of FIG. 5B.

As illustrated in FIG. 4, the second agitation chamber 105 is located on a side of the first partitioning wall 102B opposite from the first agitation chamber 103 (lower side in FIG. 4). The second agitation chamber 105 extends from the part of the side wall 102D on one short side of the housing 102 toward the part of the side wall 102D on the other short side, similarly to the first agitation chamber 103. In the second agitation chamber 105, a second agitating member 108 shaped like a rod is provided rotatably with an axial direction along the long-side direction of the housing 102. Inside the housing 102, a developing chamber 111 is provided on one side of the second agitation chamber 105 (lower side in FIG. 4) to house the developing roller 104. The second agitation chamber 105 and the developing chamber 111 are continuously provided without any partitioning member therebetween.

As illustrated in FIG. 4, the first partitioning wall 102B has openings at opposite ends. One of the openings at the opposite ends (an opening located on the left side of FIG. 4) serves as an inlet 116, and the other opening (an opening located on the right side of FIG. 4) serves as an outlet 118. Therefore, the first agitation chamber 103 and the second agitation chamber 105 are connected via the inlet 116 and the outlet 118. Developer G (see FIG. 3) stored inside the housing 102 is transported from the inlet 116 toward the outlet 118 (in the rightward direction in FIG. 4) by rotation of the first agitating member 106. Further, the developer G is transported from the outlet 118 toward the inlet 116 (in the leftward direction in FIG. 4) by rotation of the second agitating member 108. As the developer G is transported by the first agitating member 106 and the second agitating member 108, it moves from the first agitation chamber 103 to the second agitation chamber 105 via the outlet 118 and moves from the second agitation chamber 105 to the first agitation chamber 103 via the inlet 116. Thus, as shown by open arrows, the developer G circulates in the clockwise direction in FIG. 4. A part of the developer G in the second agitation chamber 105 is supplied to the developing roller 104.

As illustrated in FIG. 3, the developing roller 104 includes a magnet roller 104A fixed with an axial direction along the long-side direction of the housing 102, and a developing sleeve 104B supported rotatably and coaxially with the magnet roller 104A on an outer side of the magnet roller 104A. The magnet roller 104A has plural magnetic poles along the circumferential direction, and generates a magnetic force for attracting or repelling the developer G.

The developing sleeve 104B retains the developer G on its outer peripheral surface, and develops a latent image on the photoconductor 22 with toner T to form a toner image TZ. In FIG. 4, an area on the developing roller 104 in which the developer G is attracted is shown by a two-dot chain line. Further, in FIG. 4, a use region K of the developer G in the Z-direction is shown by arrows. The use region K refers to a region on the developing roller 104 in which the developer G is retained and which is used to develop the latent image on the photoconductor 22 (see FIG. 3).

The first agitating member 106 and the second agitating member 108 will be described further.

As illustrated in FIG. 4, the first agitating member 106 includes a columnar shaft portion 106A having an axial direction along the long-side direction of the housing 102, a thick shaft portion 106B formed by increasing the diameter of a part of the shaft portion 106A, and a spiral first blade portion 106C provided on the outer peripheries of the shaft portion 106A and the thick shaft portion 106B. The first agitating member 106 rotates on its axis to agitate and transport the developer G in a fixed direction (a direction from the left to the right that is shown by open arrows in FIG. 4).

As illustrated in FIG. 5C, the thick shaft portion 106B is a columnar portion extended in the radial direction of the shaft portion 106A (see FIG. 5B). The diameter of the thick shaft portion 106B is larger than the diameter of the shaft portion 106A and smaller than the diameter of the first blade portion 106C. In the structural example illustrated in FIG. 4, the thick shaft portion 106B is provided at a position that is closer to the short side where the auxiliary storage chamber 107 is provided than the axial center of the shaft portion 106A and that is not adjacent to the auxiliary storage chamber 107. More specifically, a part of the shaft portion 106A that is not adjacent to the auxiliary storage chamber 107 and is not the thick shaft portion 106B exists between the position of the shaft portion 106A adjacent to the auxiliary storage chamber 107 and the position of the thick shaft portion 106B.

As described above, at the position where the thick shaft portion 106B is provided, the cross-sectional area of the flow passage for the developer G in the first agitation chamber 103 is smaller than in the part of the shaft portion 106A except for the thick shaft portion 106B. For this reason, the developer G stays inside the first agitation chamber 103 on the upstream side of the thick shaft portion 106B in the transport direction of the developer G.

As illustrated in FIG. 4, the second agitating member 108 includes a columnar shaft portion 108A having an axial direction along the long-side direction of the housing 102, and a spiral second blade portion 108B provided on an outer periphery of the shaft portion 108A. The second agitating member 108 rotates on its axis to agitate and transport the developer G in a direction opposite from the transport direction of the first agitating member 106 (a direction from the right to the left that is shown by open arrows in FIG. 4).

The interval of the second blade portion 108B in the second agitating member 108 is substantially equal to the interval of the first blade portion 106C in the first agitating member 106. Therefore, the transport speed at which the developer G is transported by the first agitating member 106 and the transport speed at which the developer G is transported by the second agitating member 108 are substantially equal, and are referred to as a first transport speed (g/m) hereinafter.

Auxiliary Storage Chamber and Transport Member

As illustrated in FIGS. 2 and 5A, the auxiliary storage chamber 107 is located on a side of the second partitioning wall 102C opposite from the first agitation chamber 103, is surrounded by the bottom wall 102A, the second partitioning wall 102C, and the side wall 102D, and stores developer G (see FIG. 3). Further, an inner bottom surface of the auxiliary storage chamber 107 is located at a position higher (higher in FIG. 5A) than the inner bottom surface 103A of the first agitation chamber 103. While the auxiliary storage chamber 107 has an opening in an upper part, a part of the opening is covered with an upper wall portion 121, as illustrated in FIG. 2. A part of the opening that is not covered with the upper wall portion 121 and is close to the short side of the housing 102 (left side in FIG. 2) is referred to as a first opening 117A, and a part of the opening located on a side provided far from the short side (right side in FIG. 2) is referred to as a second opening 117B. In the exemplary embodiment, the developer G in the auxiliary storage chamber 107 is supplied to the first agitation chamber 103 via the first opening 117A, and the developer G in the first agitation chamber 103 is taken into the auxiliary storage chamber 107 via the second opening 117B.

In the developing device 100 illustrated in FIG. 4, a region provided on the upstream side (left side in FIG. 4) of the thick shaft portion 106B in the first agitation chamber 103 in the transport direction of the developer G and facing the second opening 117B of the auxiliary storage chamber 107 is referred to as a staying region R. In the staying region R, the developer G stays because the flow of the developer G is limited by the thick shaft portion 106B.

Figure 6:
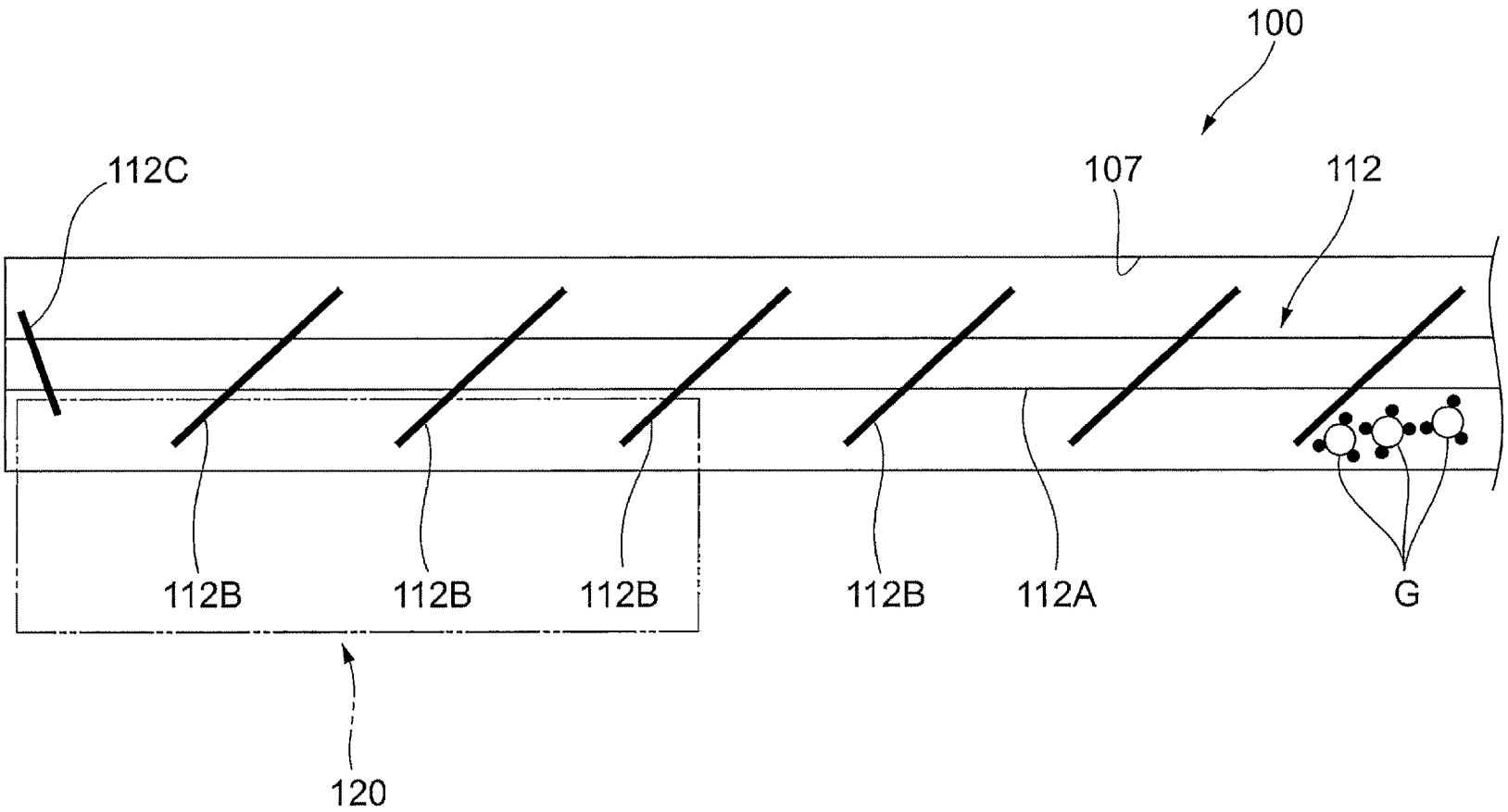
FIG. 6 illustrates a structure of a transport member provided in an auxiliary storage unit.

FIG. 6 illustrates a structure of the transport member 112 provided in the auxiliary storage chamber 107.

As illustrated in FIGS. 4 and 5A, the transport member 112 is provided in the auxiliary storage chamber 107 to rotate on its axis along the long-side direction of the housing 102. As illustrated in FIG. 6, the transport member 112 includes a columnar rotation shaft 112A, a spiral third blade portion 112B provided on an outer periphery of the rotation shaft 112A, and a fourth blade portion 112C provided on the outer periphery of the rotation shaft 112A and oriented in a direction opposite from the direction of the third blade portion 112B. The third blade portion 112B transports developer G from the second opening 117B toward the first opening 117A in the auxiliary storage chamber 107 (from the right to the left in FIG. 6) along with rotation of the rotation shaft 112A. Thus, the developer G enters the auxiliary storage chamber 107 from the second opening 117B, is transported by the transport member 112, and is discharged out of the auxiliary storage chamber 107 from the first opening 117A. The amount of developer transported per unit time by the transport member 112 is referred to as a second transport speed (g/m) hereinafter.

First Rotating Member

Next, the first rotating member 120 will be described.

As illustrated in FIG. 3, a through hole 115A is provided in a position of the covering member 115 corresponding to the first rotating member 120. The first rotating member 120 is provided with an axial direction along the long-side direction of the housing 102 at the position of the through hole 115A of the covering member 115. The first rotating member 120 is a roller that retains the developer G on its outer periphery by magnetic force, and includes a magnet 120A and a sleeve 120B.

The magnet 120A is shaped like a column, and is fixed to the housing 102. As an example, the magnet 120A includes a magnetic pole N (pickup pole) that picks up developer G in the auxiliary storage chamber 107 and causes the developer G to be attracted on the outer periphery of the sleeve 120B and a magnetic pole S (retaining pole) that retains the developer G on the outer periphery of the sleeve 120B.

The sleeve 120B is shaped like a cylinder that covers the outer periphery of the magnet 120A, and is provided rotatably around the magnet 120A. The sleeve 120B is controlled so that it continuously rotates during rotations of the first agitating member 106 and the second agitating member 108.

The magnetic pole N of the magnet 120A is located at a position where the first rotating member 120 is opposed to the transport member 112 with the first opening 117A being disposed therebetween. In the example of FIG. 3, the magnetic pole N is located at a so-called 8 o'clock position. The magnetic pole S is located at a position where the first rotating member 120 is opposed to a supply port 119A of the hopper unit 119 to be described later. In the example of FIG. 3, the magnetic pole S is located at a so-called 12 o'clock position. The positions of these magnetic poles are just exemplary, and are not limited to the illustrated ones. It is only necessary that the magnetic pole N serving as the pickup pole should be provided at a suitable position to attract the developer G in the auxiliary storage chamber 107 and that the magnetic pole S serving as the retaining pole should be provided at a position such as to retain the developer G to a position where the attracted developer G does not return to the auxiliary storage chamber 107. Further, a magnetic pole (pickoff pole) for peeling the developer G retained on the outer periphery of the sleeve 120B off the sleeve 120B may be provided ahead of the magnetic pole S serving as the retaining pole in the rotating direction of the sleeve 120B. As an example, the pickoff pole is formed by a magnetic pole S, and is located at a position where the first rotating member 120 is opposed to the first agitating member 106 (a so-called 4 o'clock position in the example of FIG. 3).

In the first rotating member 120, the rotation speed of the sleeve 120B is controlled so that it increases when the first transport speed of the first agitating member 106 and the second agitating member 108 for the developer G is increased and the second transport speed of the transport member 112 for the developer G is increased. Also, the rotation speed of the sleeve 120B is controlled so that it decreases when the first transport speed of the first agitating member 106 and the second agitating member 108 for the developer G is decreased and the second transport speed of the transport member 112 for the developer G is decreased.

In the first rotating member 120 having this structure, the developer G in the auxiliary storage chamber 107 is attracted onto the outer periphery of the sleeve 120B by the magnetic pole N of the magnet 120A, and the sleeve 120B rotates on its axis to transport the developer G from the inside of the auxiliary storage chamber 107 toward the first agitation chamber 103 via the supply port 119A. That is, the first rotating member 120 rotates to attract the developer G in the auxiliary storage chamber 107 on its surface opposed to the auxiliary storage chamber 107, to oppose the surface on which the developer G is attracted to the supply port 119A, and to then oppose the surface to the first agitation chamber 103 so that the developer G is released from attraction. When the sleeve 120B passes over the magnetic pole S of the magnet 120A, the developer G is released from attraction, and drops into the first agitation chamber 103 by its own weight.

Second Rotating Member

Figure 7:
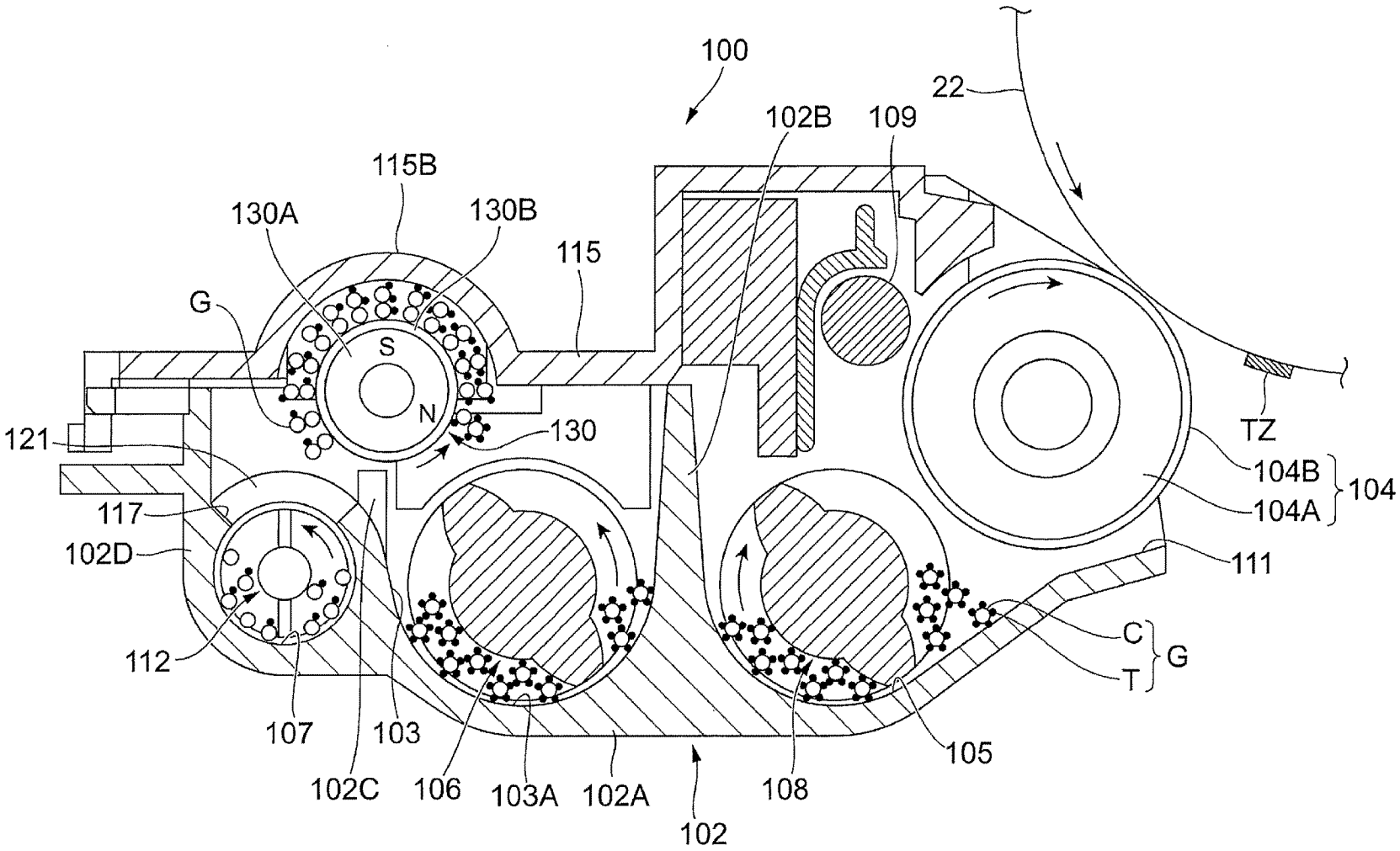
FIG. 7 is an enlarged cross-sectional view corresponding to FIG. 5A.

Next, the second rotating member 130 will be described. FIG. 7 is an enlarged cross-sectional view corresponding to FIG. 5A.

As illustrated in FIG. 7, a curved portion 115B that projects toward the outside of the developing device 100 (upward in the example of FIG. 7) to have an arch-shaped cross section is provided at a position of the covering member 115 corresponding to the second rotating member 130. The second rotating member 130 is provided with an axial direction along the long-side direction of the housing 102 in a space formed by the curved portion 115B of the covering member 115. The second rotating member 130 is a roller that retains the developer G on its outer periphery by magnetic force, and includes a magnet 130A and a sleeve 130B.

The magnet 130A has a columnar shape, and is fixed to the housing 102. As an example, the magnet 130A includes a magnetic pole N (pickup pole) that picks up the developer G in the first agitation chamber 103 and attracts the developer G on the outer periphery of the sleeve 130B, and a magnetic pole S (retaining pole) that retains the developer G on the outer periphery of the sleeve 130B.

The sleeve 130B is shaped like a cylinder that covers the outer periphery of the magnet 130A, and is provided rotatably around the magnet 130A. The sleeve 130B is controlled so that it continuously rotates during rotations of the first agitating member 106 and the second agitating member 108. Further, the sleeve 130B rotates in a direction opposite from the rotating direction of the sleeve 120B of the first rotating member 120 and at a rotation speed substantially equal to the rotation speed of the sleeve 120B. Although not particularly illustrated, as a specific structural example, the sleeve 120B and the sleeve 130B are rotated by the same driving source, and the sleeve 120B and the sleeve 130B are rotated in opposite directions by combination of gears.

The magnetic pole N of the magnet 130A is disposed at a position where the second rotating member 130 is opposed to the first agitating member 106. In the example of FIG. 7, the magnetic pole N is disposed at a so-called 4 o'clock position. Further, the magnetic pole S is disposed at a position where the surface of the sleeve 130B is the highest. In the example of FIG. 7, the magnetic pole S is disposed at a so-called 12 o'clock position. The positions of these magnetic poles are just exemplary, and are not limited to the illustrated ones. It is only necessary that the magnetic pole N serving as the pickup pole should be provided at a suitable position to attract the developer G staying in the staying region R of the first agitation chamber 103 and that the magnetic pole S serving as the retaining pole should be provided at a position to retain the developer G to a position where the attracted developer G does not return to the first agitation chamber 103. A magnetic pole (pickoff pole) that peels the developer G retained on the outer periphery of the sleeve 130B off the sleeve 130B may be provided ahead of the magnetic pole S serving as the retaining pole in the rotating direction of the sleeve 130B. As an example, the pickoff pole is formed by a magnetic pole S, and is disposed at a position where the second rotating member 130 is opposed to the transport member 112 with the second opening 117B being disposed therebetween (a so-called 8 o'clock position in the example of FIG. 7).

In the second rotating member 130, the rotation speed of the sleeve 130B is controlled so that it increases and decreases in accordance with changes of the first transport peed of the first agitating member 106 and the second agitating member 108 for the developer G and the second transport speed of the transport member 112 for the developer G, similarly to the sleeve 120B in the first rotating member 120.

In the second rotating member 130 having this structure, the developer G in the first agitation chamber 103 is attracted onto the outer periphery of the sleeve 130B by the magnetic pole N of the magnet 130A, and the sleeve 130B rotates on its axis to transport the developer G from the inside of the first agitation chamber 103 toward the auxiliary storage chamber 107 via the upper side of the second rotating member 130. That is, the second rotating member 130 rotates to attract the developer G in the first agitation chamber 103 onto its surface opposed to the first agitation chamber 103 and to oppose the surface on which the developer G is attracted to the auxiliary storage chamber 107 via the upper side of the second rotating member 130 so that the developer G is released from attraction. When the sleeve 130B passes over the magnetic pole S of the magnet 130A, the developer G is released from attraction, and drops into the auxiliary storage chamber 107 by its own weight.

Driving Control Unit and Driving Unit

As illustrated in FIGS. 2 and 4, the speed switch section 110 includes a driving control unit 60 and a driving unit 70 whose operation is controlled by the driving control unit 60. The driving control unit 60 is included in the controller 50 illustrated in FIG. 1. The driving unit 70 includes unillustrated motors and gears, and rotates the first agitating member 106, the second agitating member 108, the transport member 112, the developing roller 104, the first rotating member 120, and the second rotating member 130.

In FIGS. 2 and 4, the driving control unit 60 performs control so that the developing roller 104, the first rotating member 120, the second rotating member 130, and the transport member 112 rotate at their respective set rotation speeds. Further, the driving control unit 60 performs control to change the rotation speed of the first agitating member 106 and the second agitating member 108 when an image forming speed (transport speed of paper P on which a toner image TZ (see FIG. 1) is to be formed is changed in the image forming apparatus 10 (see FIG. 1) under control of the controller 50. A reference speed (for example, a speed in normal operation) is set for the image forming speed of the image forming apparatus 10, and the rotation speed of the first agitating member 106 and the second agitating member 108 corresponding to the reference image forming speed serves as a reference rotation speed. When the ratio of toner T in the developer G (toner concentration) decreases and the density of a toner image TZ (image density) decreases in the image forming apparatus 10, control is performed to increase the image forming speed.

Specifically, when increasing the image forming speed in the image forming apparatus 10, the speed switch section 110 increases the first transport speed for the developer G by increasing the rotation speed of the first agitating member 106 and the second agitating member 108. When decreasing the above-described image forming speed, the speed switch section 110 decreases the first transport speed for the developer G by decreasing the rotation speed of the first agitating member 106 and the second agitating member 108.

Further, as an example, the speed switch section 110 increases the rotation speeds of the transport member 112, the first rotating member 120, and the second rotating member 130 when increasing the image forming speed in the image forming apparatus 10 (see FIG. 1). As an example, the speed switch section 110 decreases the rotation speeds of the transport member 112, the first rotating member 120, and the second rotating member 130 when decreasing the image forming speed in the image forming apparatus 10.

Hopper Unit

As illustrated in FIG. 3, a hopper unit 119 that stores toner T is provided above the through hole 115A of the covering member 115. In a bottom portion of the hopper unit 119, a supply port 119A through which the toner T is to be supplied to the developing device 100 is provided. The supply port 119A communicates with the through hole 115A.

Between a wall portion around the supply port 119A and an outer peripheral surface of the first rotating member 120, there is a gap having a size such as to be closed by a magnetic brush formed by a set amount of developer G on the outer peripheral surface of the first rotating member 120. Therefore, when the amount of developer G for forming a magnetic brush is less than the set amount, the gap between the wall portion around the supply port 119A and the outer peripheral surface of the first rotating member 120 is opened. That is, the supply port 119A is closed in response to the increase in amount of developer G that forms a magnetic brush retained by the first rotating member 120, and is opened in response to the decrease in amount of developer G. When the supply port 119A is in a closed state, toner T is not supplied into the housing 102. In contrast, when the supply port 119A is in an open state, toner T is supplied from the hopper unit 119 into the housing 102 through the supply port 119A.

Circulation of Developer

Here, a description will be given of circulation (flow) of developer G inside the developing device 100.

As illustrated in FIG. 4, when the first agitating member 106 and the second agitating member 108 are rotated by the driving unit 70, developer G in the first agitation chamber 103 is transported by the first agitating member 106 in a direction of illustrated open arrows (rightward direction in FIG. 4). At this time, toner T and carrier C in the developer G are agitated. When the developer G reaches a downstream end portion in the first agitation chamber 103, it passes through the outlet 118 and flows into the second agitation chamber 105.

The developer G flowing in the second agitation chamber 105 is transported by the second agitating member 108 in a direction of illustrated open arrows (leftward direction in FIG. 4). Thus, the developer G is transported to the use region K while the toner T and the carrier C are agitated. In the use region K, a part of the developer G that is being transported is supplied to the developing roller 104, and is retained on the outer peripheral surface of the developing roller 104 by magnetic force. The remaining part of the developer G that is not retained on the developing roller 104 reaches a downstream end portion in the second agitation chamber 105, passes through the inlet 116, and flows into the first agitation chamber 103. In this way, the developer G circulates inside the first agitation chamber 103 and the second agitation chamber 105.

Around the thick shaft portion 106B in the first agitation chamber 103, the cross-sectional area of the flow passage in which the developer G passes is smaller than in the part where the thick shaft portion 106B is not provided (see FIGS. 5B and 5C). For this reason, the developer G stays to form the staying region R at the position near and on the upstream side of the thick shaft portion 106B, and the first agitation chamber 103 is filled with the developer G.

Since the first agitation chamber 103 is filled with the developer G on the upstream side of the thick shaft portion 106B, the change in amount of developer G around the thick shaft portion 106B in the first agitation chamber 103 is suppressed. Thus, the volume of developer G transported per unit time in the transport direction by the first agitating member 106 is nearly fixed. Further, since the developer G is transported in a compressed state around the thick shaft portion 106B, resistive force acting on the developer G is nearly fixed.

Since the transport force for transporting the developer G and the resistive force acting on the developer G are thus nearly fixed by the thick shaft portion 106B in the developing device 100, the change in amount of developer G to be transported downstream of the thick shaft portion 106B may be suppressed. In the example of FIG. 4, the thick shaft portion 106B is disposed near the center portion in the first agitation chamber 103. For this reason, the transport passage in which the change in transport amount of developer G is suppressed on the downstream side of the thick shaft portion 106B is longer than when the thick shaft portion 106B is disposed near the downstream end portion of the first agitation chamber 103. Thus, the charge amount of the toner T may be suppressed from becoming less than the required charge amount.

In the developing device 100 illustrated in FIG. 4, the developer G staying in the staying region R owing to the thick shaft portion 106B is attracted on the second rotating member 130, and is transferred from the second opening 117B into the auxiliary storage chamber 107 by rotation of the second rotating member 130. The developer G entering the auxiliary storage chamber 107 is transported by the transport member 112 in the direction of open arrows in FIG. 4 (leftward direction in FIG. 4). Then, the transported developer G is attracted on the first rotating member 120, and is returned into the first agitation chamber 103 by rotation of the first rotating member 120.

In the exemplary embodiment, the developer G is moved from the first agitation chamber 103 to the auxiliary storage chamber 107 by being transported by the second rotating member 130. Hence, the amount of developer G flowing into the auxiliary storage chamber 107 is controlled by the rotation speed of the second rotating member 130. Therefore, for example, the amount of developer G flowing in the auxiliary storage chamber 107 per unit time is quantitatively controlled to be smaller than the amount of developer G in the staying region R. Since this avoids clogging of the interior of the auxiliary storage chamber 107 with the developer G, the second transport speed (g/m) of the transport member 112 for the developer G is kept close to the set transport speed.

When the first transport speed of the first agitating member 106 and the second agitating member 108 for the developer G changes, the amount of developer G staying in the staying region R changes. In the exemplary embodiment, however, since the second rotating member 130 attracts the developer G staying in the staying region R and transfers the developer G to the auxiliary storage chamber 107, the amount of developer G flowing from the second opening 117B into the auxiliary storage chamber 107 per unit time (in other words, the speed at which the developer G flows from the second opening 117B into the auxiliary storage chamber 107, hereinafter referred to as an inflow speed (g/m)) is controlled by the rotation speed of the second rotating member 130.

In the exemplary embodiment, the rotation speed of the second rotating member 130 is substantially equal to the rotation speed of the first rotating member 120. For this reason, the amount of developer G to be transferred from the auxiliary storage chamber 107 to the first agitation chamber 103 per unit time by the first rotating member 120 (in other words, the speed at which the developer G is discharged from the auxiliary storage chamber 107, hereinafter referred to as a discharging speed (g/m)) is substantially equal to the inflow speed of the developer G moved into the auxiliary storage chamber 107 by the second rotating member 130. In other words, the second rotating member 130 transports, from the first agitation chamber 103 to the auxiliary storage chamber 107, an amount of developer G corresponding to the amount of developer G transported from the auxiliary storage chamber 107 to the first agitation chamber 103 per unit time by the first rotating member 120. Therefore, when the image forming speed is stable, the amount of developer G in the auxiliary storage chamber 107 does not change greatly.

When the first transport speed of the developer G (rotation speed of the first agitating member 106 and the 108) increases, the rotation speed of the first rotating member 120 and the second rotating member 130 also increases, and the inflow speed and discharging speed of the developer G into and from the auxiliary storage chamber 107 also increase. Conversely, when the first transport speed of the developer G (rotation speed of the first agitating member 106 and the second agitating member 108) decreases, the rotation speed of the first rotating member 120 and the second rotating member 130 also decreases, and the inflow speed and discharging speed of the developer G into and from the auxiliary storage chamber 107 also decrease. Further, the second transport speed of the transport member 112 in the auxiliary storage chamber 107 for the developer G increases as the image forming speed increases, and decreases as the image forming speed decreases.

When the image forming speed is increased in the image forming apparatus 10 of the exemplary embodiment illustrated in FIG. 1, the first transport speed of the first agitating member 106 and the second agitating member 108 for the developer G increases in the developing device 100 illustrated in FIG. 4. When the image forming speed is decreased, the first transport speed for the developer G decreases. However, since all of the inflow speed relating to the operation of the second rotating member 130, the discharging speed relating to the operation of the first rotating member 120, and the second transport speed relating to the transport member 112 increase and decrease in response to the increase and decrease in the first transport speed, as described above, the amount of developer G in the auxiliary storage chamber 107 does not greatly change in the exemplary embodiment even when the image forming speed changes.

Supply of Toner

Consideration will be given to a case in which the ratio of the toner T in the developer G (toner concentration) decreases and the image density decreases in the image forming apparatus 10 illustrated in FIG. 1. In this case, the toner concentration also decreases in the developer G that is caused by the operation of the second rotating member 130 to flow from the staying region R of the first agitation chamber 103 into the auxiliary storage chamber 107. Also, the toner concentration decreases in the developer G that is transported in the auxiliary storage chamber 107 by the transport member 112 and is attracted on the first rotating member 120. When the toner concentration decreases, a magnetic brush formed on the outer peripheral surface of the first rotating member 120 by the developer G is reduced. Hence, the supply port 119A of the hopper unit 119 is put in an open state, and toner T is supplied from the hopper unit 119 into the housing 102.

Next, consideration will be given to a case in which the toner concentration is increased by supply of the toner T and the image density is returned to the required density. In this case, the toner concentration also increases in the developer G that is caused by the operation of the second rotating member 130 to flow from the staying region R of the first agitation chamber 103 into the auxiliary storage chamber 107. Also, the toner concentration increases in the developer G that is transported in the auxiliary storage chamber 107 by the transport member 112 and is attracted on the first rotating member 120. When the toner concentration increases, a magnetic brush formed on the outer peripheral surface of the first rotating member 120 by the developer G is increased. Hence, the supply port 119A of the hopper unit 119 is put in a closed state, and the supply of toner T from the hopper unit 119 into the housing 102 is restricted.

As described above, in the developing device 100 of the exemplary embodiment, the supply port 119A is opened and closed according to the toner concentration in the developer G, regardless of the image forming speed. For this reason, when the first transport speed of the developer G is changed, the difference between the amount of toner T required to maintain the density of a toner image TZ and the amount of toner T actually supplied may be suppressed from increasing. In the developing device 100 of the exemplary embodiment, since the supply port 119A is opened and closed by the magnetic brush formed on the outer periphery of the first rotating member 120, autonomous control of the toner concentration may be realized without providing a toner concentration sensor.

Here, consideration will be given to a structure such that the second rotating member 130 is not provided and the developer G staying in the staying region R of the first agitation chamber 103 flows into the auxiliary storage chamber 107 beyond the second partitioning wall 102C of the housing 102. Since the inflow speed of the developer G into the auxiliary storage chamber 107 is not controlled in this structure, when the amount of developer G staying in the staying region R of the first agitation chamber 103 increases, the inflow speed correspondingly increases. When the inflow speed exceeds the discharging speed of the developer G to be discharged by the first rotating member 120, the auxiliary storage chamber 107 is filled with the developer G. In such a situation, even when the toner concentration of the developer G in the first agitation chamber 103 decreases, much developer G that fills the auxiliary storage chamber 107 is attracted on the first rotating member 120 for a while. Since the supply port 119A of the hopper unit 119 is thereby closed, toner T is not supplied immediately. That is, followability in autonomous control of the toner concentration deteriorates.

In contrast, in the exemplary embodiment, since the inflow speed of the developer G into the auxiliary storage chamber 107 is controlled by the operation of the second rotating member 130, even when the amount of developer G staying in the staying region R of the first agitation chamber 103 increases, the inflow speed of the developer G does not increase by not less than an amount corresponding to the increase in the rotation speed of the second rotating member 130. Therefore, according to the exemplary embodiment, the auxiliary storage chamber 107 is not filled with the developer G. For this reason, toner T is supplied while sensitively following the decrease in toner concentration of the developer G in the first agitation chamber 103.

Another Structural Example of Second Rotating Member

Figure 8:
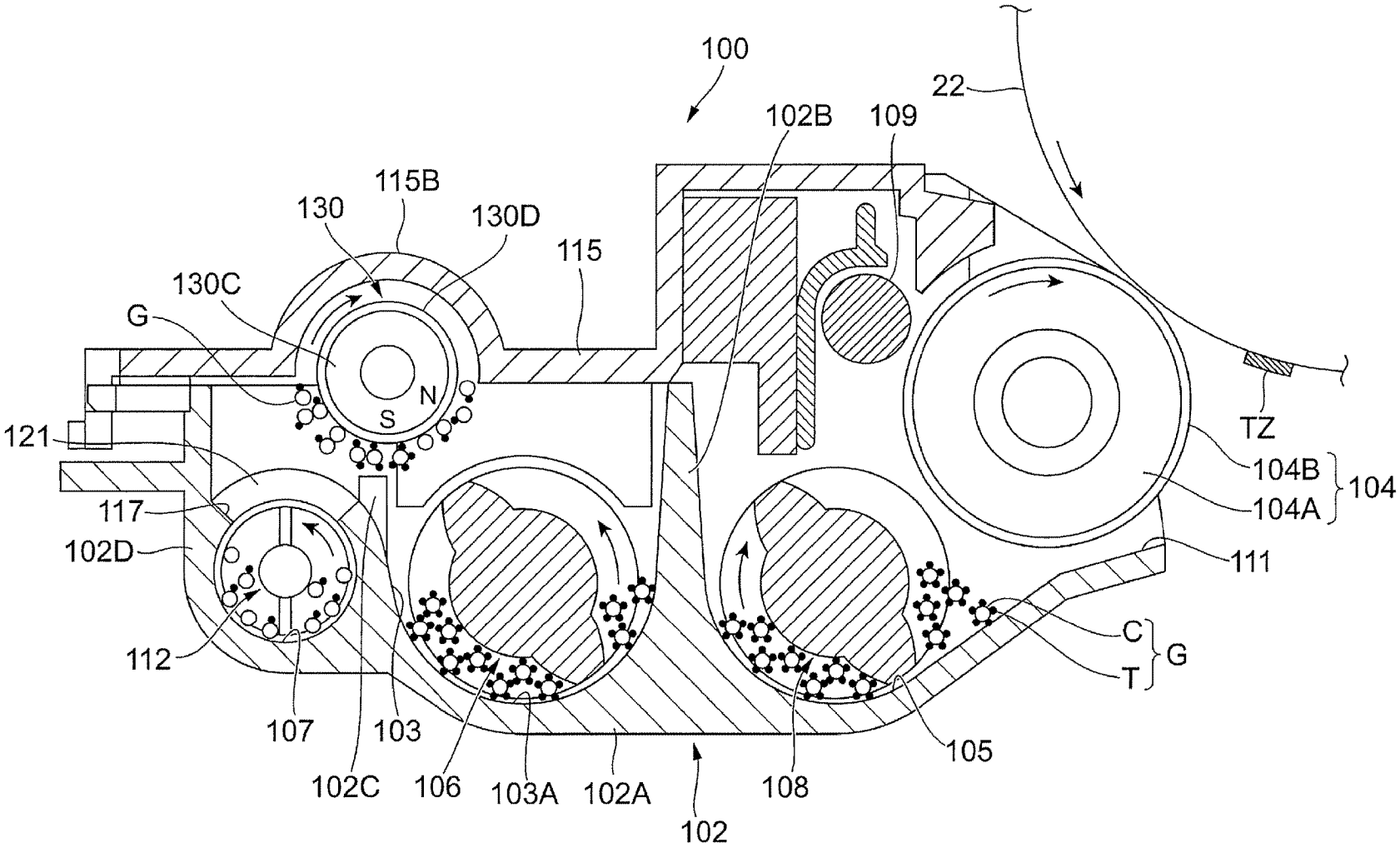
FIG. 8 is an enlarged cross-sectional view corresponding to FIG. 5A when another structural example of a second rotating member is adopted.

FIG. 8 is an enlarged cross-sectional view corresponding to FIG. 5A when another structural example of the second rotating member 130 is adopted.

In this structural example, a housing 102 of a developing device 100 has a structure similar to that of FIG. 7, and a second rotating member 130 is stored in a space formed by a curved portion 115B of a covering member 115. The second rotating member 130 illustrated in FIG. 8 includes a columnar magnet 130C and a cylindrical sleeve 130D that covers an outer periphery of the magnet 130C, similarly to the structural example of FIG. 7.

The magnet 130C includes a magnetic pole N serving as a pickup pole and a magnetic pole S serving as a retaining pole, similarly to the magnet 130A of FIG. 7. The magnetic pole N of the magnet 130C is disposed at a position where the second rotating member 130 is opposed to a first agitating member 106 (a so-called 4 o'clock position in FIG. 8), similarly to the magnetic pole N of the magnet 130A. In contrast, the magnetic pole S is disposed at a position where a surface of the sleeve 130D is the lowest, unlike the magnetic pole S of the magnet 130A. In the example of FIG. 8, the magnetic pole S is disposed at a so-called 6 o'clock position. The positions of these magnetic poles are just exemplary, and are not limited to the illustrated ones. It is only necessary that the magnetic pole N serving as the pickup pole should be located at a suitable position to attract developer G staying in a staying region R of a first agitation chamber 103 and that the magnetic pole S serving as the retaining pole should be located at a position to retain the developer G to a position where the attracted developer G does not return to the first agitation chamber 103. A magnetic pole (pickoff pole) for peeling the developer G retained on the outer periphery of the sleeve 130D off the sleeve 130D may be provided ahead of the magnetic pole S serving as the retaining pole in the rotating direction of the sleeve 130D. As an example, the pickoff pole is formed by a magnetic pole S, and is disposed at a position where the second rotating member 130 is opposed to a transport member 112 with a second opening 117B being disposed therebetween (a so-called 8 o'clock position in the example of FIG. 7).

While a first agitating member 106 and a second agitating member 108 are rotating, the sleeve 130D of the second rotating member 130 illustrated in FIG. 8 is controlled so that it continuously rotates in the same direction as the direction of a sleeve 120B of the first rotating member 120 and at a rotation speed substantially equal to the rotation speed of the sleeve 120B. The rotation axis of the second rotating member 130 may be the same as the rotation axis of the first rotating member 120. In other words, in this structural example, the sleeve 120B of the first rotating member 120 and the sleeve 130D of the second rotating member 130 rotate on the same rotation axis in the same direction. Therefore, as a specific structural example, the sleeve 120B of the first rotating member 120 and the sleeve 130D of the second rotating member 130 may be rotated as an integral cylindrical member. The sleeve 130D is controlled so that its rotation speed increases and decreases in accordance with the changes in the first transport speed of the first agitating member 106 and the second agitating member 108 for the developer G and the second transport speed of the transport member 112 for the developer G, together with the sleeve 120B of the first rotating member 120.

According to this structure, when the developer G in the first agitation chamber 103 is attracted on the outer periphery of the sleeve 130D by the magnetic pole N of the magnet 130C and the sleeve 130D rotates on its axis, the second rotating member 130 transports the developer G from the inside of the first agitation chamber 103 toward an auxiliary storage chamber 107 via a lower side of the second rotating member 130. When the sleeve 130D passes over the magnetic pole S of the magnet 130C, the developer G drops into the auxiliary storage chamber 107 by its own weight. In the structure of FIG. 8, an area from the magnetic pole N to the magnetic pole S in the sleeve 130D is opposed to the first agitation chamber 103. For this reason, the developer G may be attracted on the second rotating member 130 at a position lower than the magnetic pole N of the magnet 130C in the second rotating member 130. In this case, even when the amount of developer G staying in the staying region R of the first agitation chamber 103 is not much enough to be attracted on the pickup pole of the second rotating member 130, the developer G flows into the auxiliary storage chamber 107, and this reduces the accuracy of autonomous control over the toner concentration. Accordingly, in this structure, for example, a covering may be provided on an upper side of a second partitioning wall 102C of the housing 102 to hang toward the first agitation chamber 103 and to cover the second rotating member 130 to the height of the magnetic pole N so that the developer G is not attracted on the second rotating member 130 at the position lower than the magnetic pole N.

While the exemplary embodiment has been described above, the specific mode of the present invention is not limited to the above-described exemplary embodiment. For example, the first blade portion 106C is also provided on the thick shaft portion 106B in the first agitating member 106 in the above exemplary embodiment. Alternatively, a groove extending in the axial direction may be formed on the outer peripheral surface of the thick shaft portion 106B without forming the first blade portion 106C in the thick shaft portion 106B so that the developer G is transported from the staying region R to the downstream side of the thick shaft portion 106B via this groove. Further alternatively, for example, a platelike paddle projecting in the radial direction on the outer peripheral surface of the shaft portion 106A may be provided, instead of the thick shaft portion 106B, so as to produce a staying region R on the upstream side of the paddle.

In the above-described exemplary embodiment, the length of the auxiliary storage chamber 107 is about ⅓ of the length of the housing 102 (first agitation chamber 103). Alternatively, for example, the length of the auxiliary storage chamber 107 may be shortened to increase the sensitivity to the toner concentration. Since the degree of flexibility in arranging the auxiliary storage chamber 107 in the housing 102 is high, for example, the auxiliary storage chamber 107 may be disposed at a position that is not adjacent to the first agitation chamber 103 (for example, a position protruding leftward in FIGS. 2 and 4), depending on the attachment position of a toner cartridge.

Further, in the above-described exemplary embodiment, the second transport speed of the transport member 112 in the auxiliary storage chamber 107 for the developer G is increased and decreased in accordance with the increase and decrease of the first transport speed of the first agitating member 106 and the second agitating member 108 for the developer G. Alternatively, the second transport speed may be fixed regardless of the increase and decrease of the first transport speed under the condition that it is kept higher than the inflow speed of the developer G moved into the auxiliary storage chamber 107 by the operation of the second rotating member 130. Further alternatively, the rotation speed of the first rotating member 120 and the second rotating member 130 may also be fixed regardless of the increase and decrease of the first transport speed under the above-described condition.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a storage unit that stores developer to be used to form a developer image on an image carrier, the developer containing toner and carrier;

an auxiliary storage unit that stores the developer and is connected to the storage unit via a first opening from which the developer is supplied into the storage unit and a second opening from which the developer in the storage unit is taken in;

a first transport member provided at the first opening to transport the developer in the auxiliary storage unit into the storage unit;

a second transport member provided at the second opening to transport the developer in the storage unit into the auxiliary storage unit to be fed to the first transport member;

a third transport member provided in the auxiliary storage unit; and a supply unit that has an opening opposed to the first transport member and supplies toner to the developer transported from the auxiliary storage unit into the storage unit, wherein the first transport unit and the second transport unit are provided above the third transport member.

2. The developing device according to claim 1, wherein the second transport member transports, from the storage unit to the auxiliary storage unit, an amount of developer corresponding to the developer transported from the auxiliary storage unit to the storage unit by the first transport member.

3. The developing device according to claim 2, wherein the first transport member is a rotating body that rotates to attract the developer in the auxiliary storage unit onto a surface thereof opposed to the auxiliary storage unit, to oppose the surface to the opening of the supply unit, and to oppose the surface to the storage unit so as to release attraction of the developer, and wherein the second transport member is a rotating body that rotates to attract the developer in the storage unit onto a surface thereof opposed to the storage unit and to oppose the surface to the auxiliary storage unit so as to release attraction of the developer.

4. The developing device according to claim 3, wherein the supply unit is provided above the first transport member, wherein the first transport member rotates to oppose at least a specific surface to the auxiliary storage unit, the supply unit, and the storage unit in order, and wherein the second transport member rotates to oppose at least a specific surface to the storage unit and the auxiliary storage unit in order.

5. The developing device according to claim 4, wherein the second transport member rotates to oppose the surface on which the developer is to be attracted to the storage unit, to pass the surface above a rotation axis, and to oppose the surface to the auxiliary storage unit.

6. The developing device according to claim 4, wherein the first transport member and the second transport member rotate on the same rotation axis in the same direction.

7. The developing device according to claim 3, wherein the second transport member rotates to oppose the surface on which the developer is to be attracted to the storage unit, to pass the surface above a rotation axis, and to oppose the surface to the auxiliary storage unit.

8. The developing device according to claim 3, wherein the first transport member and the second transport member rotate on the same rotation axis in the same direction.

9. The developing device according to claim 1, wherein the first transport member is a rotating body that rotates to attract the developer in the auxiliary storage unit onto a surface thereof opposed to the auxiliary storage unit, to oppose the surface to the opening of the supply unit, and to oppose the surface to the storage unit so as to release attraction of the developer, and wherein the second transport member is a rotating body that rotates to attract the developer in the storage unit onto a surface thereof opposed to the storage unit and to oppose the surface to the auxiliary storage unit so as to release attraction of the developer.

10. The developing device according to claim 9, wherein the supply unit is provided above the first transport member, wherein the first transport member rotates to oppose at least a specific surface to the auxiliary storage unit, the supply unit, and the storage unit in order, and wherein the second transport member rotates to oppose at least a specific surface to the storage unit and the auxiliary storage unit in order.

11. The developing device according to claim 10, wherein the second transport member rotates to oppose the surface on which the developer is to be attracted to the storage unit, to pass the surface above a rotation axis, and to oppose the surface to the auxiliary storage unit.

12. The developing device according to claim 10, wherein the first transport member and the second transport member rotate on the same rotation axis in the same direction.

13. The developing device according to claim 9, wherein the second transport member rotates to oppose the surface on which the developer is to be attracted to the storage unit, to pass the surface above a rotation axis, and to oppose the surface to the auxiliary storage unit.

14. The developing device according to claim 9, wherein the first transport member and the second transport member rotate on the same rotation axis in the same direction.

15. The developing device according to claim 1, wherein the second transport member is disposed upstream, in a transport direction of developer, of the first opening of the auxiliary storage unit.

16. The developing device according to claim 1, wherein the first transport member and the second transport member are arranged between the storage unit and the auxiliary storage unit.

17. The developing device according to claim 1, wherein the first transport member and the second transport member each include a magnet.

18. The developing device according to claim 17, wherein poles of the magnet of the first transport member are oriented in a different direction that poles of the magnet of the second transport member.

19. An image forming apparatus comprising:

an image carrier;

a storage unit that stores developer to be used to form a developer image on the image carrier, the developer containing toner and carrier;

an auxiliary storage unit that stores the developer and is connected to the storage unit via a first opening from which the developer is supplied into the storage unit and a second opening from which the developer in the storage unit is taken in;

a first transport member provided at the first opening to transport the developer in the auxiliary storage unit into the storage unit;

a second transport member provided at the second opening to transport the developer in the storage unit into the auxiliary storage unit to be fed to the first transport member;

a third transport member provided in the auxiliary storage unit;

a supply unit that has an opening opposed to the first transport member and supplies toner to the developer transported from the auxiliary storage unit into the storage unit; and a transfer unit that transfers the developer image formed on the image carrier onto a recording medium, wherein the first transport unit and the second transport unit are provided above the third transport member.

20. The developing device according to claim 19, wherein the second transport member is disposed upstream, in a transport direction of developer, of the first opening of the auxiliary storage unit.

* * * * *